US010058910B2

(12) United States Patent
Weyland

(10) Patent No.: US 10,058,910 B2
(45) Date of Patent: Aug. 28, 2018

(54) RIVETING TOOL

(71) Applicant: TKR Spezialwerkzeuge GmbH, Gevelsberg (DE)

(72) Inventor: Thorsten Weyland, Herdecke (DE)

(73) Assignee: TKR Spezialwerkzeuge GmbH, Gevelsberg (DE)

( * ) Notice: Subject to any disclaimer, the term of this patent is extended or adjusted under 35 U.S.C. 154(b) by 318 days.

(21) Appl. No.: 14/951,988

(22) Filed: Nov. 25, 2015

(65) Prior Publication Data

US 2016/0151828 A1 Jun. 2, 2016

(30) Foreign Application Priority Data

Nov. 27, 2014 (DE) ..... 10 2014 117 401

(51) Int. Cl.

| | |
|---|---|
| ***B21D 9/05*** | (2006.01) |
| ***B21J 15/30*** | (2006.01) |
| ***B21J 15/04*** | (2006.01) |
| ***B21J 15/10*** | (2006.01) |
| ***B21J 15/20*** | (2006.01) |
| ***B25B 27/00*** | (2006.01) |

(52) U.S. Cl.

CPC ..... *B21J 15/30* (2013.01); *B21J 15/043* (2013.01); *B21J 15/10* (2013.01); *B21J 15/20* (2013.01); *B25B 27/0007* (2013.01)

(58) Field of Classification Search

CPC . B21J 15/043; B21J 15/30; B21J 15/10; B21J 15/20; B23B 31/28; B25B 27/007

USPC ..... 29/243.524

See application file for complete search history.

(56) References Cited

U.S. PATENT DOCUMENTS

| | | | | |
|---|---|---|---|---|
| 4,462,240 | A | 7/1984 | Yamamoto | |
| 9,796,014 | B2 * | 10/2017 | Weyland | B23B 31/28 |
| 9,833,832 | B2 * | 12/2017 | Weyland | B21J 15/043 |

(Continued)

FOREIGN PATENT DOCUMENTS

| | | |
|---|---|---|
| DE | 867 939 B | 7/1949 |
| DE | 29502918 U1 | 8/1996 |
| DE | 20206000 U1 | 9/2002 |

(Continued)

OTHER PUBLICATIONS

European Search Report and Written Opinion dated Apr. 26, 2016 in Application No. EP1519802.2 (German only) (7 pages).

(Continued)

*Primary Examiner* — David B Jones

(74) *Attorney, Agent, or Firm* — Flaster/Greenberg P.C.

(57) ABSTRACT

The invention relates to a riveting tool for setting blind rivet nuts and/or blind rivet screws with a drive piston hydraulically adjustable between a starting position and an end position and a pull rod operationally connected with the drive piston and adjustable between a rivet receiving position and a setting position. In order to provide a riveting tool with a hydraulically driven drive piston, which has a simple and good adaptability for the blind rivet screws and/or blind rivet nuts to be set, it is provided that a coupling unit, a tractive tool adjusted for the blind rivet nut and/or blind rivet screw as well as the pull rod are designed for the form-fitting connection of the pull rod with the tractive tool, which is releasable in the direction of the longitudinal axis and in the circumferential direction.

28 Claims, 2 Drawing Sheets

(56) References Cited

U.S. PATENT DOCUMENTS

| | | | |
|---|---|---|---|
| 2006/0196029 | A1 | 9/2006 | Klann |
| 2013/0104360 | A1 | 5/2013 | Liu |

FOREIGN PATENT DOCUMENTS

| | | | |
|---|---|---|---|
| DE | 202005003450 | U1 | 5/2005 |
| DE | 202006014717 | U1 | 12/2006 |
| DE | 10 2008 013 044 | B3 | 7/2009 |
| DE | 102010054251 | A1 | 6/2011 |
| DE | 202011005601 | U1 | 9/2011 |
| DE | 20 2012 103 803 | A1 | 5/2013 |
| DE | 20 2012 001 633 | U1 | 7/2013 |
| DE | 102012101894 | A1 | 9/2013 |
| EP | 0927585 | A2 | 7/1999 |
| EP | 0940227 | A2 | 9/1999 |
| EP | 1400190 | A2 | 3/2004 |
| EP | 2786843 | A2 | 10/2014 |

OTHER PUBLICATIONS

European Search Report and Written Opinion dated May 2, 2016 in Application No. EP15195717.4 (German only) (7 pages).

First Chinese Office Action dated Sep. 12, 2017 in Chinese counterpart application No. 201510836322.4 with English translation (15 pages).

European Office Action dated Apr. 20, 2018 in counterpart European application No. 15195802.2 (5 pages) (German only).

* cited by examiner

RIVETING TOOL

BACKGROUND OF THE INVENTION

Field of the Invention

The invention relates to a riveting tool for setting blind rivet nuts and/or blind rivet screws with

- a drive piston hydraulically adjustable between a starting position and an end position and
- a pull rod operationally connected with the drive piston and adjustable between a rivet receiving position and a setting position.

Description of Related Art

Blind rivet nuts and/or blind rivet screws are rivets with threads, which are used e.g. when a bottom side, an inside or a back side of a component is not accessible or is hard to access, as is the case e.g. with tubes. Blind rivet nuts and/or blind rivet screws are used in particular in order to apply threads to components which have a wall thickness that is too thin to enable the cutting in of threads.

Riveting tools of the initially named type are used to fasten the blind rivet nuts and/or blind rivet screws comfortably on the respective component. Depending on the rivet to be set, the pull rod adjustable between the rivet receiving position and the setting position is connected with a tractive tool, which has an internal or external thread adjusted for the respective rivet to be set. For setting the blind rivet nut and/or the blind rivet screw, it is screwed onto the tractive tool, inserted into the opening of the component for receiving the rivet and set by the stroke of the riveting tool.

In order to be able to set different blind rivet nuts and/or blind rivet screws with a riveting tool, it is necessary to design the riveting tool such that it can be used with different tractive tools adjusted for the blind rivet nuts and/or screws to be set. The tractive tools must thereby be coupleable in a simple manner with the pull rod in order to guarantee a good applicability of the riveting tool. However, known riveting tools with hydraulically driven drive pistons of the initially named type have the disadvantage that they do not enable or, if possible, only enable a very restricted and involved change of the tractive tool due to the complexity of the hydraulic drive unit.

BRIEF SUMMARY OF THE INVENTION

The object of the invention is to provide a riveting tool with a hydraulically driven drive piston, which has a simple and good adaptability for the blind rivet screws and/or blind rivet nuts to be set.

The invention solves the object through a riveting tool with the characteristics of claim 1. Advantageous further embodiments of the invention are specified in the dependent claims.

It is characteristic of the riveting tool according to the invention that a coupling unit, a tractive tool adjusted for the blind rivet nut and/or blind rivet screw as well as the pull rod are designed for the form-fitting connection of the pull rod with the tractive tool, which is releasable in the direction of the longitudinal axis and in the circumferential direction.

It is provided according to the invention that a simple replacement of the tractive tool can take place through the use of a coupling unit. The coupling unit, the pull rod as well as the respective tractive tool are thereby coordinated with respect to each other so that, in the installed state, the pull rod and the tractive tool are interconnected in a form-fitting manner both in the direction of the longitudinal axis as well as in the circumferential direction. The form-fitting connection in the direction of the longitudinal axis, namely in the adjustment direction of the drive piston, reliably ensures that the movements of the drive piston are transmitted to the tractive tool via the pull rod so that the stroke required to set the blind rivet nut or blind rivet screw is applied to the rivet by the tractive tool.

The form-fitting connection between the tractive tool and the pull rod in the circumferential direction makes it possible to transmit rotational movements of the pull rod around the longitudinal axis from the pull rod to the tractive tool. The tractive tool can thus be easily released in particular after the setting procedure of the set blind rivet nut and/or blind rivet screw through a twisting of the pull rod. Moreover, the transmissibility of the rotational movement can also be used to arrange the blind rivet nut and/or blind rivet screw to be set on the tractive tool before the setting procedure via a twisting of the pull rod. A transmission of the movement from the pull rod to the tractive tool in the direction of the longitudinal axis generally takes place via the coupling unit. It can also be designed to transmit the movement in the circumferential direction, wherein the form fit required for this can also be established directly between the pull rod and the tractive tool.

The riveting tool according to the invention is thus characterized in that a simple and quick interchangeability of the tractive tool via the coupling unit is given, wherein a reliable transmission of the adjustment movement of the pull rod in the direction of the longitudinal axis as well as in the circumferential direction is enabled due to an interaction of the coupling unit, the tractive tool and the pull rod.

The design of the coupling unit is thereby in principle freely selectable, wherein it must be adjusted in the area of a connection section of the tractive tool and pull rod, in the area of which the coupling unit is connected with the tractive tool and the pull rod, for the design of the pull rod and the tractive tool in order to establish at least a form fit in the direction of the longitudinal axis. It is provided according to a particularly advantageous design of the invention that the coupling unit has two coupling half shells that are designed for the form-fitting connection of the pull rod with the tractive tool in the direction of the longitudinal axis. The design of the coupling unit with two coupling half shells enables a particularly simple and quick replacement of the tractive tool. The coupling half shells are thereby designed such that they interact with the pull rod and the tractive tool such that a form fit is established in the direction of the longitudinal axis by the coupling half shells.

A change of the tractive tool can be realized in a simple manner in that the tractive tool is inserted into one of the coupling half shells and the coupling unit is then closed by placement of the other coupling half shell on the tractive tool and the pull rod so that the pull rod and the tractive tool progress axially to the annularly arranged coupling half shells. The coupling half shells thereby effectuate at least one form-fitting connection of the pull rod and tractive tool in the direction of the longitudinal axis so that the linear movement created by the drive piston is transmitted to the tractive tool. Moreover, the coupling half shells can also be used to establish the form-fitting connection in the circumferential direction, for example when they are designed with webs progressing in the direction of the longitudinal axis that interact with corresponding grooves on the tractive tool and the pull rod.

The basic design of the coupling half shells, the pull rod and the tractive tool such that they have a form-fitting connection at least in the direction of the longitudinal axis via the coupling half shells is in principle freely selectable. It is however provided according to a particularly advantageous embodiment of the invention that the pull rod and the tractive tool in the coupling section have annularly circumferential grooves and the coupling half shells have webs that can be brought to engage with the grooves. According to this design of the invention, the coupling half shells surround the tractive tool and the pull rod in a connection section coaxially, wherein annularly circumferential webs protruding from the coupling half shells in the direction towards the tractive tool and the pull rod engage in corresponding annular grooves on the pull rod and the tractive tool in the connection section. The number of interacting grooves and webs can thereby be freely selected in principle. In any case, this design represents a simple and reliable form-fitting connection in the direction of the longitudinal axis. Moreover, according to this further embodiment of the invention, the tractive tool can be changed in a simple manner.

As already explained above, the coupling unit can also be designed such that, in addition to a form-fitting connection of the pull rod with the tractive tool in the direction of the longitudinal axis, it also effectuates a form-fitting connection of the tractive tool and the pull rod in the circumferential direction. It is however provided according to an advantageous further development of the invention that a web progressing transversely to the direction of the longitudinal axis is arranged on one of the tractive tool and pull rod in the contact area of the tractive tool and pull rod and a correspondingly designed groove progressing transversely to the direction of the longitudinal axis is arranged on the other of the tractive tool and pull rod.

According to this embodiment of the invention, the connection of the pull rod and tractive tool, which is form-fitting, i.e. torque-proof, in the circumferential direction, takes place in that at least one web interacts with at least one groove adjusted for the web. The web engaging in the groove effectuates a reliable torque-proof connection between the pull rod and the tractive tool due to its alignment transversely to the direction of the longitudinal axis. The alignment of the web as well as of the groove as well as their quantity transversely to the direction of the longitudinal axis is thereby in principle freely selectable. The webs for example can thus be arranged crosswise, whereby a particularly reliable, torque-proof connection is achieved. The contact area of the pull rod and of the tractive tool is thereby the section, at which these two components abut against each other in the installed state.

A reliable alignment of the tractive tool with respect to the pull rod can already be achieved through the drive piston and/or the coupling unit, in particular the interconnected coupling half shells. It is however provided according to a particularly advantageous design of the invention that a centering pin that can be brought to engage with the tractive tool and the pull rod is arranged in the contact area of the tractive tool and pull rod. The centering pin, which can be arranged with one section in an opening of the pull rod and with another section in an opening of the tractive tool, enables a particularly reliable alignment of the pull rod with respect to the tractive tool. It is also possible to anchor the centering pin on one of the pull rod or tractive tool and to provide an opening corresponding to the centering pin on the other of the tractive tool and pull rod, into which the centering pin engages in the installation position.

For setting a blind rivet nut and/or blind rivet screw, the drive piston effectuates, during an adjustment from its starting position into its end position, a displacement of the pull rod and of the tractive tool connected with the pull rod from the rivet receiving position into a setting position. After the setting procedure is complete, the tractive tool is then released from the blind rivet nut or respectively blind rivet screw by twisting the pull rod and tractive tool. This separation process can be executed in a particularly simple manner when the pull rod is arranged in the receiving position. In order to ensure a reliable arrangement of the tractive tool in the rivet receiving position, it is thus provided according to an advantageous further development of the invention that the pull rod is pretensioned in the direction towards the rivet receiving position and/or the drive piston is pretensioned in the direction towards the starting position. The pretensioning can thereby occur in principle in any manner, wherein it can be effectuated by a helical compression spring in a particularly preferred manner, which is reinforced on the end side, e.g. on a flange of the pull rod, and on the side lying opposite the flange, e.g. on a threaded sleeve connected with the base body. In the case of the arrangement of the flange on a stop surface of the drive piston, it is thereby ensured that, through the spring pretensioning, the drive piston and the pull rod are arranged in the unloaded state in the rivet receiving position of the pull rod.

The design of the operative connection of the drive piston with the pull rod is in principle freely selectable. It is however provided according to a particularly advantageous design of the invention that the pull rod is arranged in a through opening of the drive piston and is connected with it in a form-fitting manner in the direction towards the rivet receiving position. According to this design of the invention, the drive piston has a through opening progressing in the direction of the longitudinal axis, within which the pull rod can be arranged. The arrangement of the pull rod thereby takes place such that it is connected in a form-fitting manner with the drive piston in the direction towards the rivet receiving position. According to this, a displacement of the pull rod in the direction towards the rivet receiving position effectuates a displacement of the unloaded drive piston in the direction towards its starting position. In the same manner, in this embodiment of the invention, a displacement of the drive piston in the direction towards the end position effectuates a displacement of the pull rod from the rivet receiving position into the setting position.

The arrangement of the drive piston in the through opening makes it possible to design the riveting tool in a particularly compact structural shape. The form-fitting connection according to this embodiment of the invention of the drive piston and pull rod also ensures a high functional reliability with a comparatively simple structure.

The arrangement of a blind rivet nut and/or blind rivet screw to be set on the tractive tool can generally take place through simple screwing of the blind rivet nut and/or blind rivet screw onto the tractive tool. After the setting procedure, a twisting of the tractive tool is required in order to separate the riveting tool from the set blind rivet nut and/or blind rivet screw, wherein such a rotational movement is transmitted to the tractive tool via the pull rod. The generation of the rotational movement of the pull rod can thereby take place in any manner.

It is however provided according to a particularly advantageous embodiment of the invention that the pull rod is connected with a guide pin connected with a rotary wheel for the displaceable and torque-proof connection in the direction of the longitudinal axis. According to this embodiment of the invention, the riveting tool has a guide pin connected with a rotary wheel, wherein the guide pin is connected in a torque-proof manner with the pull rod. A twisting of the rotary wheel thus effectuates a twisting of the pull rod and thus in turn a twisting of the tractive tool. The guide pin is thereby advantageously connected with the pull rod such that the pull rod is adjustable relative to the guide pin in the direction of the longitudinal axis. This makes it possible to adjust the pull rod in the direction of the longitudinal axis between its rivet receiving position and the setting position without an axial displacement of the guide pin, wherein the pull rod is thereby adjusted relative to the guide pin in the direction of the longitudinal axis.

This embodiment of the invention thus enables a compact structure of the riveting tool. A connection between the pull rod and guide pin, in which the guide pin has a longitudinal groove, through which a fastening bolt connected with the pull rod extends, thereby represents a particularly simple embodiment. Rotational movements of the guide pin can thus be reliably transmitted to the pull rod and thus to the tractive tool via the fastening bolt. An assembly consisting of a pull rod, guide pin, rotary wheel and, if applicable, spring element can hereby be simultaneously established, which, as an installed unit, can be easily released from the riveting tool for the purpose of changing the riveting tool. A complicated handling of the individual parts is not required so that a quick change of the riveting tool can take place.

A guiding of the tractive tool during the setting procedure can be realized in principle in any manner. It is however provided according to a particularly advantageous embodiment of the invention that the coupling half shells in the installed state are movably mounted in a guide sleeve arranged on a housing of the riveting tool. The housing forming the base body of the riveting tool, which can also be used to guide the hydraulic cylinder between its starting position and its end position and thereby provides a cylinder space for the hydraulic piston, enables a simple receiving of a guide sleeve, which is adjusted with its inner surface to the dimensions of the coupling unit formed by the coupling half shells and thus provides guidance. The guide sleeve can thereby also be designed such that it determines with a stop for the coupling half shells the starting position of the drive piston. The guide sleeve can be screwed e.g. directly to the housing or be fastened to it using suitable sleeve receivers connected with the housing.

In order to perform the setting procedure, it is required that a rivet head adjusted for the tractive tool and the blind rivet nut and/or blind rivet screw to be set is arranged on the riveting tool. It is thereby provided according to a particularly advantageous design that the guide sleeve has a rivet head receiver with holding magnets arranged in the rivet head receiver. This design of the invention permits a simple and quick change of the rivet head for adjustment for the tractive tool to be used. The use of holding magnets thereby ensures a secure arrangement of the different rivet heads in the rivet head receiver of the guide sleeve, wherein for this the holding magnets can be arranged for example coaxially around a through opening for the tractive tool.

The connection of the housing with e.g. the rotary wheel and/or the guide sleeve can take place in any manner, as already explained above. It is however provided according to a particularly advantageous embodiment of the invention that the cylindrical housing that is connectable with a hydraulic line and that has a cylindrical inner surface for guiding the drive piston has an internal thread on one or both sides.

The arrangement of internal threads makes it possible in a particularly simple manner to appropriately adjust the riveting tool via the housing, which serves to guide the drive piston with a cylindrical inner surface, for the different uses. A change in the attachment parts for the housing can be accomplished quickly and easily. In order to drive the drive piston, the housing is connected with a connecting piece for a hydraulic line such that a pressure increase effectuates a displacement of the drive piston from the starting position into the end position.

BRIEF DESCRIPTION OF THE SEVERAL VIEWS OF THE DRAWINGS

An exemplary embodiment of the invention is explained below with reference to the drawings. The drawings show the following.

DETAILED DESCRIPTION OF THE INVENTION

Figure 1:
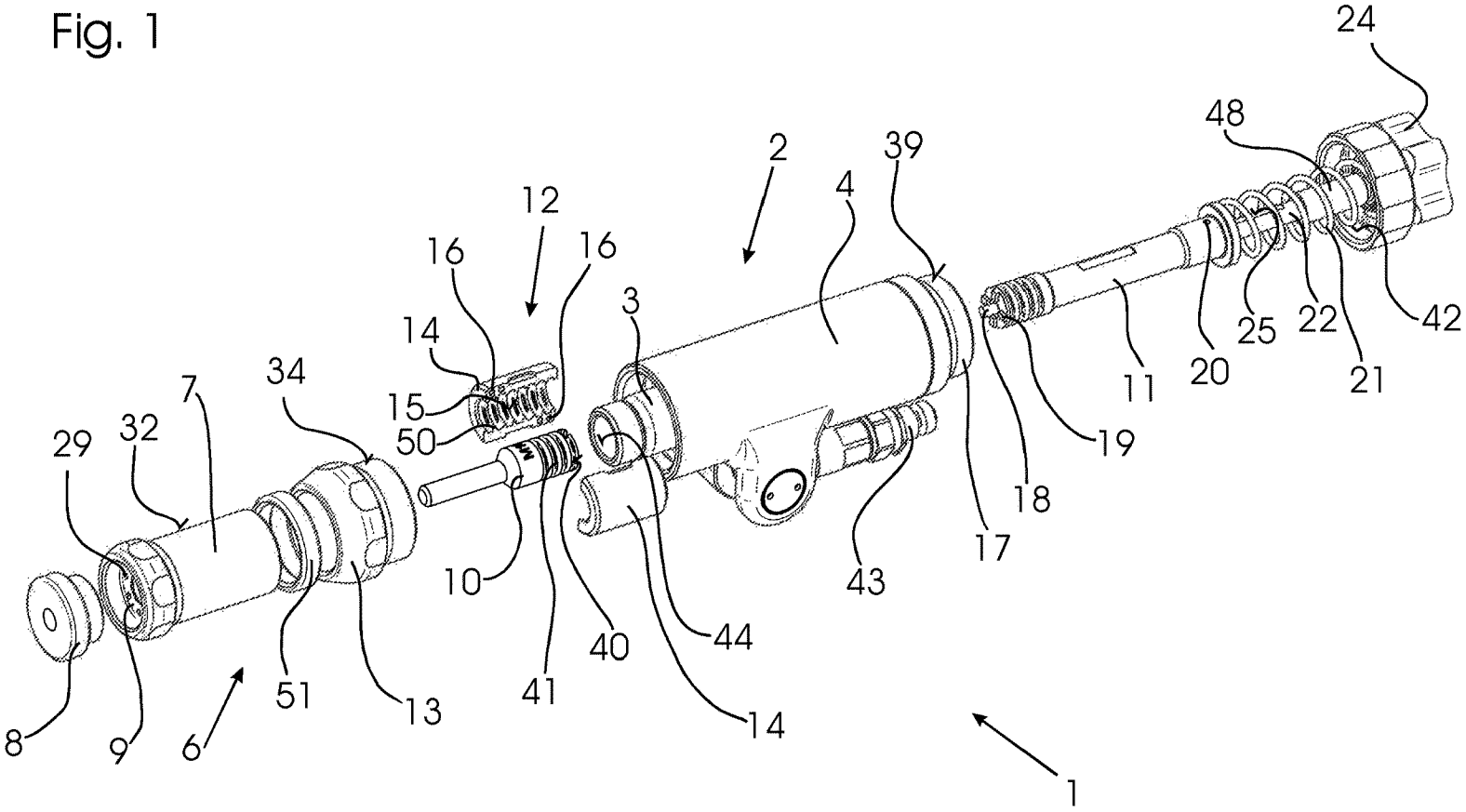
FIG. 1 an exploded representation of a riveting tool.
Figure 2:
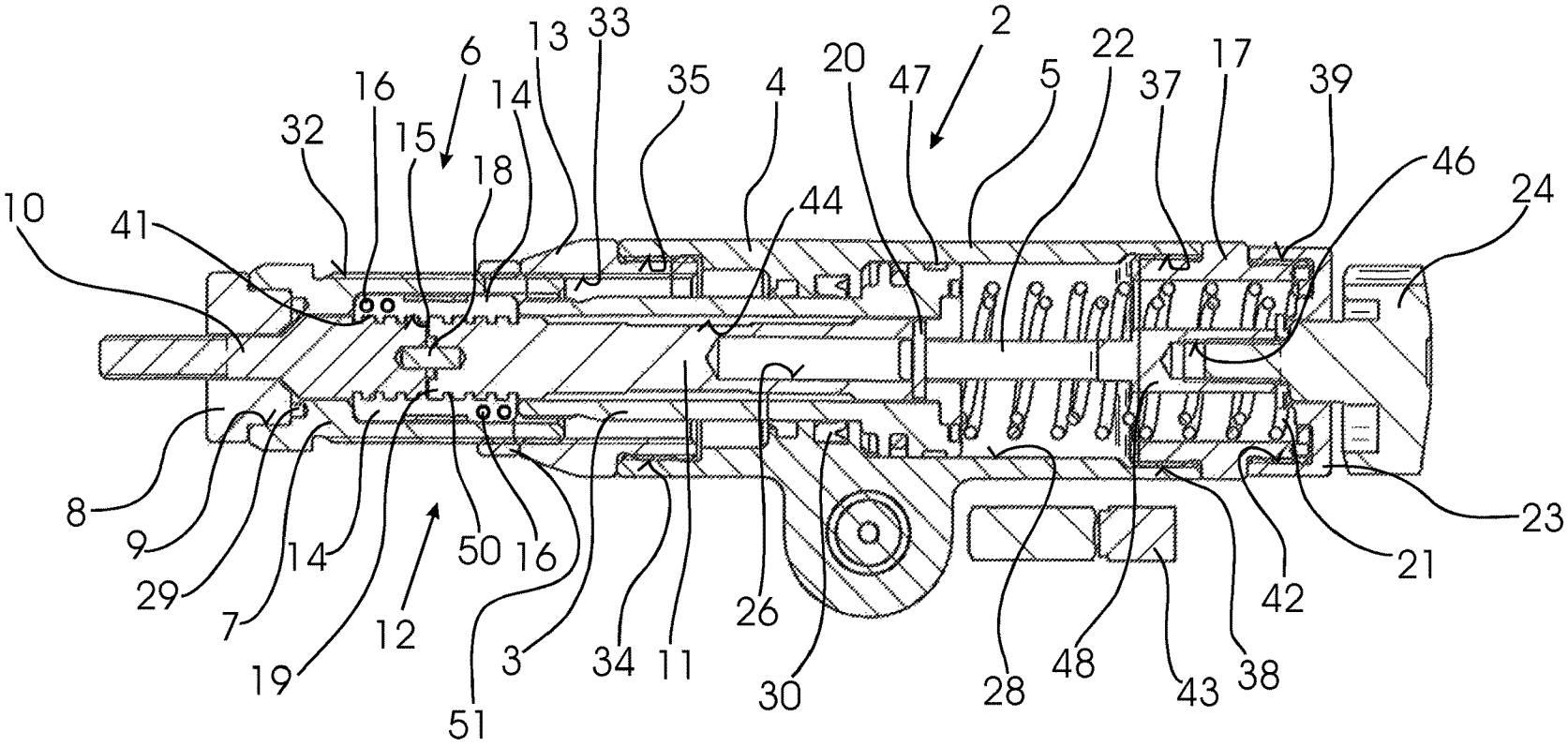
FIG. 2 a sectional view of the riveting tool from FIG. 1.

FIGS. 1 and 2 show an exemplary embodiment of a riveting tool 1 in an exploded representation (FIG. 1) and in a sectional view (FIG. 2).

The riveting tool 1 has, as the central structural element, a drive unit 2, which has a housing 4 as well as a drive piston 3 adjustably mounted in the housing 4 between a starting position and an end position. The adjustment of the drive piston 3 thereby takes place hydraulically, wherein the drive piston 3 in the area of a cylinder section 5 of the housing 4 is mounted in a liquid-tight manner within the housing 4 on a cylinder inner surface 28 so that a pressurization of the drive piston 3 via a hydraulic line that is connectable to a connecting piece 43 and that is not shown here effectuates a displacement of the drive piston 3 out of the starting position shown in FIG. 1 into an end position (not shown here). In order to seal the cylinder section 5 of the housing 4 that is pressurizable with hydraulic fluid, a ring seal 30 for sealing with respect to the drive piston 3 is arranged within the housing 4 and a ring seal 47 abutting against the cylinder inner surface 28 is arranged on the drive piston 3.

The drive piston 3 serves to adjust a pull rod 11, which is releasably connected with a tractive tool 10 in the direction of the longitudinal axis as well as in the circumferential direction via a coupling unit 12. The pull rod 11 thereby extends within a through opening 44 of the drive piston 3 wherein the insertion depth of the pull rod 11 into the drive piston 3 is restricted by a flange facing the drive piston 3, which abuts against a stop surface of the drive piston 3 in the installed position in the direction of the longitudinal axis. For the form-fitting connection of the pull rod 11 with the tractive tool 10 via the coupling unit 12 in the direction of the longitudinal axis and in the circumferential direction, the pull rod 11 and the tractive tool 10 have annularly circumferential projections 41 in a connection section in contact with the coupling unit 12. Two coupling half shells 14 used to form the coupling unit 12 have in the installed state inwardly protruding grooves 15 and webs 50, which engage in the grooves of pull rod 11 and tractive tool 10 arranged between the projections 41 and thus establish a form-fitting connection in the direction of the longitudinal axis. In the installed state, the position of the coupling half shells 14 is also secured via pins arranged on one coupling half shell 14 and not shown here, which engage in pin receivers 16 of the other coupling half shell 14.

For the torque-proof connection of pull rod 11 and tractive tool 10, they have webs 19 and grooves 40 engaging with each other in the contact area facing each other and progressing transversely to the direction of the longitudinal axis, wherein the webs 19 are arranged crosswise on the front side facing the tractive tool 10 and the tractive tool 10 has correspondingly crosswise designed grooves 40 on its front side facing the pull rod 11. In the installed state, a centering pin 18 protruding from the front surface of the pull rod 11 in the direction towards the tractive tool 10 also serves to secure the position of the tractive tool 10 with respect to the pull rod 11, wherein the tractive tool 10 engages in a correspondingly designed bore hole of the tractive tool 10. In order to guide the tractive tool 10 between the position assigned to the rivet receiving position and the setting position of the pull rod 11, the riveting tool 10 is provided with a guide sleeve 7 forming a guide unit 6, which is adjusted on the inside for the diameter of the coupling unit 12 and thus serves as a linear guide. The guide sleeve 7 is thereby fastened on an internal thread 33 of a sleeve receiver 13 via an external thread 32, which is fixed on an internal thread 35 arranged on the housing 4 via an external thread 34. A locking ring 51, which is arranged coaxially to the guide sleeve 7 and abuts against a front surface of the sleeve receiver 13, thereby serves to secure the position of the guide sleeve 7 on the sleeve receiver 13.

The guide sleeve 7 has a rivet head receiver 9 for receiving a rivet head 8 adjusted for the tractive tool 10, within which several holding magnets 29 are arranged annularly and coaxially to a through opening, which enable a releasable fastening of the rivet head 8 on the guide sleeve 7.

The pull rod 11 releasably connected with the tractive tool 10 forms, with a guide pin 22, a threaded sleeve 23, a rotary wheel 24 and a helical compression spring 21, a structural unit connected in a non-releasable manner in normal operation. The pull rod 11 thereby has a bore hole 26, within which the guide pin 22 is axially movable. The axial movability is thereby determined via the length of a slit 25 extending through the guide pin 22 in the direction of the longitudinal axis, wherein a fastening bolt 20 connected with the pull rod 11 extends through this slit 25. The fastening bolt 20 also guarantees a transmission of the rotational movements of the guide pin 22 towards the pull rod 11, wherein this rotational movement is then transmitted to the tractive tool 10.

The rotational movement of the guide pin 22 is thereby effectuated by the actuation of a rotary wheel 24, which is arranged in a torque-proof manner in a receiving opening 46 of a receiving section 48 of the guide pin 22. For the releasable arrangement of the structural unit made up of the pull rod 11, guide pin 22, threaded sleeve 23, helical compression spring 21 and rotary wheel 24 on the housing 4, the threaded sleeve 23 has an internal thread 42, which can be screwed onto an external thread 39 of an adapter bushing 17, wherein the adapter bushing 17 with a further external thread section 38 can be screwed into an internal thread 37 of the housing 4. Different structural units having a pull rod 11 can thus be combined with a uniform housing 4 of a riveting tool 1 via the adapter bushing 17. The helical compression spring 21 is reinforced on one end against an inner surface of the threaded sleeve 23 and on the other end on a flange of the pull rod 11. In the installed state, the helical compression spring 21 thus pretensions the pull rod 11 in the direction towards the drive piston 3. A displacement of the drive piston 3 as well as of the pull rod 11 connected with the drive piston 3 in a form-fitting manner in the direction of the longitudinal axis from the starting position into the end position thus takes place against the spring force of the helical compression spring 21.

REFERENCE LIST

1 Riveting tool
2 Drive unit
3 Drive piston
4 Housing
5 Cylinder section
6 Guide unit
7 Guide sleeve
8 Rivet head
9 Rivet head receiver
10 Tractive tool
11 Pull rod
12 Coupling unit
13 Shell receiver
14 Coupling half shell
15 Grooves
16 Pin receiver
17 Adapter bushing
18 Centering pin
19 Webs
20 Fastening bolt
21 Helical compression spring
22 Guide pin
23 Threaded sleeve
24 Rotary wheel
25 Slit
26 Bore hole
28 Cylinder inner surface
29 Holding magnet
30 Ring seal
32 External thread
33 Internal thread
34 External thread
35 Internal thread
37 Internal thread
38 External thread
39 External thread
40 Grooves
41 Projections
42 Internal thread
43 Connecting piece
44 Through opening
46 Receiving opening
47 Ring seal
48 Receiving section
50 Webs
51 Locking ring

I claim:

1. A riveting tool for setting blind rivet nuts and/or blind rivet screws with a hydraulic drive piston adjustable in a direction of a longitudinal axis of the riveting tool between a starting position and an end position and a pull rod operationally connected with the hydraulic drive piston and adjustable between a rivet receiving position and a setting position as the drive piston is adjusted between the starting position and the end position, a tractive tool for receiving a blind rivet head and/or a blind rivet screw adapted for the tractive tool; and a coupling unit having two coupling half shells, wherein there is a form fitting connection of the pull rod and the tractive tool by the coupling unit, the tractive tool and the pull rod, such that the pull rod is releasably connected to the tractive tool in the direction of the longitudinal axis and in a circumferential direction and wherein in a coupling section of the pull rod and of the tractive tool have annularly circumferential grooves and the coupling half shells have webs for engaging with the grooves.

2. The riveting tool according to claim 1, wherein the two coupling half shells are designed to provide the form-fitting connection of the pull rod and the tractive tool in the direction of the longitudinal axis.

3. The riveting tool according to claim 1, wherein a web extending transversely to the direction of the longitudinal axis is arranged on one of the tractive tool and the pull rod in a contact area of the tractive tool and the pull rod and a correspondingly configured groove extending transversely to the direction of the longitudinal axis is arranged on the other of the tractive tool and pull rod.

4. The riveting tool according to claim 1, wherein a centering pin that can be brought to engage with the tractive tool and the pull rod is arranged in a contact area of the tractive tool and the pull rod.

5. The riveting tool according to claim 1, wherein the pull rod is pretensioned in a direction towards the rivet receiving position and/or the drive piston in a direction towards the starting position.

6. The riveting tool according to claim 1, wherein the drive piston comprises a through opening, and the pull rod is arranged in the through opening of the drive piston and the pull rod is in a form-fitting connection to the drive piston in a direction towards the rivet receiving position.

7. The riveting tool according to claim 1, further comprising a guide pin connected with a rotary wheel, wherein the pull rod has a displaceable and torque-proof connection with the guide pin in the direction of the longitudinal axis.

8. The riveting tool according to claim 1, further comprising a guide sleeve and a housing, wherein the two coupling half shells are movably mounted in the guide sleeve arranged on the housing.

9. The riveting tool according to claim 8, wherein the guide sleeve has a rivet head receiver and the rivet head receiver comprises holding magnets arranged in the rivet head receiver.

10. The riveting tool according to claim 1, further comprising a housing connectable with a hydraulic line, wherein the housing has a cylindrical inner surface for guiding the drive piston and an internal thread on one or both sides of the housing.

11. A riveting tool for setting blind rivet nuts and/or blind rivet screws with

- a hydraulic drive piston adjustable in a direction of a longitudinal axis of the riveting tool between a starting position and an end position,
- a pull rod operationally connected with the hydraulic drive piston and adjustable between a rivet receiving position and a setting position as the drive piston is adjusted between the starting position and the end position,
- a tractive tool for receiving a blind rivet head and/or a blind rivet screw adapted for the tractive tool; and
- a coupling unit, wherein
- there is a form-fitting connection of the pull rod and the tractive tool by the coupling unit, the tractive tool and the pull rod, such that the pull rod is releasably connected to the tractive tool in the direction of the longitudinal axis and in a circumferential direction,
- wherein the drive piston comprises a through opening, and the pull rod is arranged in the through opening of the drive piston, and
- wherein the pull rod is in a form-fitting connection to the drive piston in a direction towards the rivet receiving position.

12. The riveting tool according to claim 11, wherein the coupling unit has two coupling half shells designed to provide the form-fitting connection of the pull rod and the tractive tool in the direction of the longitudinal axis.

13. The riveting tool according to claim 12, further comprising a guide sleeve and a housing, wherein the two coupling half shells are movably mounted in the guide sleeve arranged on the housing.

14. The riveting tool according to claim 13, wherein the guide sleeve has a rivet head receiver and the rivet head receiver comprises holding magnets arranged in the rivet head receiver.

15. The riveting tool according to claim 11, wherein a web extending transversely to the direction of the longitudinal axis is arranged on one of the tractive tool and the pull rod in a contact area of the tractive tool and the pull rod and a correspondingly configured groove extending transversely to the direction of the longitudinal axis is arranged on the other of the tractive tool and pull rod.

16. The riveting tool according to claim 11, wherein a centering pin that can be brought to engage with the tractive tool and the pull rod is arranged in a contact area of the tractive tool and the pull rod.

17. The riveting tool according to claim 11, wherein the pull rod is pretensioned in a direction towards the rivet receiving position and/or the drive piston in a direction towards the starting position.

18. The riveting tool according to claim 11, further comprising a guide pin connected with a rotary wheel, wherein the pull rod has a displaceable and torque-proof connection with the guide pin in the direction of the longitudinal axis.

19. The riveting tool according to claim 11, further comprising a housing connectable with a hydraulic line, wherein the housing has a cylindrical inner surface for guiding the drive piston and an internal thread on one or both sides of the housing.

20. The riveting tool according to claim 11, further comprising a housing connectable with a hydraulic line, wherein the housing has a cylindrical inner surface for guiding the drive piston and an internal thread on one or both sides of the housing.

21. A riveting tool for setting blind rivet nuts and/or blind rivet screws with

- a hydraulic drive piston adjustable in a direction of a longitudinal axis of the riveting tool between a starting position and an end position,
- a pull rod operationally connected with the hydraulic drive piston and adjustable between a rivet receiving position and a setting position as the drive piston is adjusted between the starting position and the end position,
- a tractive tool for receiving a blind rivet head and/or a blind rivet screw adapted for the tractive tool; and
- a coupling unit
- a guide pin and a rotary wheel, wherein
  - there is a form-fitting connection of the pull rod and the tractive tool by the coupling unit, the tractive tool and the pull rod, such that the pull rod is releasably connected to the tractive tool in the direction of the longitudinal axis and in a circumferential direction,
  - wherein the guide pin is connected with a rotary wheel, and the pull rod has a displaceable and torque-proof connection with the guide pin in the direction of the longitudinal axis.

22. The riveting tool according to claim 21, wherein the coupling unit has two coupling half shells designed to provide the form-fitting connection of the pull rod and the tractive tool in the direction of the longitudinal axis.

23. The riveting tool according to claim 22, further comprising a guide sleeve and a housing, wherein the two coupling half shells are movably mounted in the guide sleeve arranged on the housing.

24. The riveting tool according to claim 23, wherein the guide sleeve has a rivet head receiver and the rivet head receiver comprises holding magnets arranged in the rivet head receiver.

25. The riveting tool according to claim 21, wherein a web extending transversely to the direction of the longitudinal axis is arranged on one of the tractive tool and the pull rod in a contact area of the tractive tool and the pull rod and a correspondingly configured groove extending transversely to the direction of the longitudinal axis is arranged on the other of the tractive tool and pull rod.

26. The riveting tool according to claim 21, wherein a centering pin that can be brought to engage with the tractive tool and the pull rod is arranged in a contact area of the tractive tool and the pull rod.

27. The riveting tool according to claim 21, wherein the pull rod is pretensioned in a direction towards the rivet receiving position and/or the drive piston in a direction towards the starting position.

28. A riveting tool for setting blind rivet nuts and/or blind rivet screws with a hydraulic drive piston adjustable in a direction of a longitudinal axis of the riveting tool between a starting position and an end position, a pull rod operationally connected with the hydraulic drive piston and adjustable between a rivet receiving position and a setting position as the drive piston is adjusted between the starting position and the end position, a tractive tool for receiving a blind rivet head and/or a blind rivet screw adapted for the tractive tool; and a coupling unit having two coupling half shells, wherein the two coupling half shells provide a form-fitting connection of the pull rod and the tractive tool in the direction of the longitudinal axis, such that the pull rod is releasably connected to the tractive tool in the direction of the longitudinal axis and in a circumferential direction.

* * * * *